US010937614B1

(12) United States Patent
Wang et al.

(10) Patent No.: US 10,937,614 B1
(45) Date of Patent: Mar. 2, 2021

(54) SWITCH MODULE WITH A BUILT-IN STRUCTURE OF ANTI-SURGE AND LINKAGE DISCONNECTION

(71) Applicants: Yi-Hsiang Wang, Taoyuan (TW); I-Ying Wang, Taoyuan (TW)

(72) Inventors: Yi-Hsiang Wang, Taoyuan (TW); I-Ying Wang, Taoyuan (TW)

( * ) Notice: Subject to any disclaimer, the term of this patent is extended or adjusted under 35 U.S.C. 154(b) by 0 days.

(21) Appl. No.: 16/710,174

(22) Filed: Dec. 11, 2019

(51) Int. Cl.

| | |
|---|---|
| ***H01H 37/76*** | (2006.01) |
| ***H01H 71/18*** | (2006.01) |
| ***H01H 89/04*** | (2006.01) |
| ***H01C 7/12*** | (2006.01) |
| ***H01H 83/20*** | (2006.01) |
| ***H01H 85/08*** | (2006.01) |
| ***H01H 85/175*** | (2006.01) |

(52) U.S. Cl.
CPC ..... *H01H 37/761* (2013.01); *H01C 7/126* (2013.01); *H01H 71/18* (2013.01); *H01H 83/20* (2013.01); *H01H 85/08* (2013.01); *H01H 85/175* (2013.01); *H01H 89/04* (2013.01)

(58) Field of Classification Search
CPC ..... H01H 37/761; H01H 89/04; H01H 71/18; H01H 71/20; H01H 83/10; H01H 23/20; H01H 9/0271; H01H 2205/002; H01H 2235/028; H01H 73/26; H01H 2235/01; H01H 37/76; H01H 23/162; H01H 23/24; H01H 2037/762; H01H 61/02; H01H 13/14; H01H 2223/00; H01H 2085/0283; H01H 23/105; H01H 85/175; H01H 85/08; H01H 85/36; H01C 7/12; H01C 7/126; H01C 10/36; H02H 9/041; H02H 3/38
USPC ..... 337/59, 333, 334, 345, 350
See application file for complete search history.

(56) References Cited

U.S. PATENT DOCUMENTS

| | | | | |
|---|---|---|---|---|
| 5,760,672 | A * | 6/1998 | Wang | H01H 71/62 337/66 |
| 6,876,290 | B2 * | 4/2005 | Yu | H01H 73/26 337/56 |
| 7,248,140 | B2 * | 7/2007 | Yu | H01H 71/7436 337/56 |
| 7,688,174 | B2 * | 3/2010 | Hung | H01H 23/025 337/66 |
| 2003/0102953 | A1 * | 6/2003 | Wang | H01H 73/26 337/37 |
| 2011/0109421 | A1 * | 5/2011 | Lee | H01H 9/0271 337/112 |

(Continued)

*Primary Examiner* — Stephen S Sul
(74) *Attorney, Agent, or Firm* — Rosenberg, Klein & Lee

(57) ABSTRACT

A switch module with a built-in structure of anti-surge and linkage disconnection, particularly to one that has an anti-surge instant expanding detaching device with a cocoon form protection structure, when an overvoltage occurs, the metal oxide varistor would instantly heat up or explode, and the expanded graphite is linear expanded by absorbing heat and forms a cocoon form protection structure that fill up the containing space like a spider web covering the metal oxide varistor to forms a flame proof layer, when the expanding volume of the expanded graphite reach the predetermined setting, the expansion provides a push force pushing the pushing element forcing the first connecting point detaching from the second connecting point and turning off the switch, and further achieving the effects of easy manufacturing and improving the stability and the accuracy.

6 Claims, 14 Drawing Sheets

(56) References Cited

U.S. PATENT DOCUMENTS

| | | | | |
|---|---|---|---|---|
| 2012/0067708 | A1* | 3/2012 | Lee | H01H 71/18<br>200/293 |
| 2012/0229246 | A1* | 9/2012 | Depping | H01H 37/36<br>337/114 |
| 2016/0006235 | A1* | 1/2016 | Wang | H01H 85/08<br>361/91.2 |
| 2016/0233041 | A1* | 8/2016 | Wang | H01H 23/105 |
| 2017/0047180 | A1* | 2/2017 | Wang | H01C 7/126 |
| 2017/0148601 | A1* | 5/2017 | Wang | H01H 9/0271 |
| 2017/0148602 | A1* | 5/2017 | Wang | H01H 37/761 |

* cited by examiner

SWITCH MODULE WITH A BUILT-IN STRUCTURE OF ANTI-SURGE AND LINKAGE DISCONNECTION

BACKGROUND OF THE INVENTION

1. Field of the Invention

The present invention relates to a switch module with a built-in structure of anti-surge and linkage disconnection, particularly to one that has an anti-surge instant expanding detaching device with a cocoon form protection structure.

2. Description of the Related Art

FIGS. 1A and 1B disclose a conventional overcurrent protection switch 10 comprises a housing 11 with a press button 12 on the top, a first terminal 12*a*, a second terminal 12*b*, a third terminal 12*c* separately arranged at the bottom. The first terminal 12*a* has a bimetal plate 13 and a first contact 131; the second terminal 12*b* has a second contact 121 corresponding to the first contact 131. The moving element 14 has one end linking the bottom of the press button 12 and the other linking the moving terminal of the bimetal plate 13, whereby the pressing of the press button 12 actuates the first contact 131 connecting to the second contact 121 and therefore turns on the device; while overcurrent occurs, the bimetal plate 13 deforms due to high degree of temperature and disconnects the first and second contact 131, 121, turning off the device so as to form an overcurrent protection switch 10. Such structure can be found in Taiwan patent applications No. 540811, 367091, 320335, 262168, and 208384. However, the structure disclosed above aims at protection from overcurrent situation but is not able to protect the device when sudden overvoltage such as lightning strike occurs.

Therefore, for safety concern, a usual solution to the defect is to parallel connect to a metal oxide varistor, and to connect to a thermal fuse in series.

FIG. 2A is the invention of U.S. Pat. No. 8,643,462. It discloses an anti-surge switch module applied in an electric system 30. The switch module comprises a power switch 105, an insulating member 106, a surge absorber 107 and a pyrocondensation belt 108. The insulating member 106 engages with the power switch 105 that abutting against the surge absorber 107; and the pyrocondensation belt 108 ties the surge absorber 107 and the insulating member 106 together so that it could contract when receiving the heat from the surge absorber 107 and thus turn off the power switch 105 under certain degree of contracting. However, the insulating member 106, the surge absorber 107 and the pyrocondensation belt 108 are not disposed inside the power switch 105 but are connected outside, failing to form a complete device with the power switch 105.

In short, the structures disclosed above have shortcomings as uncertain quality, possible exceeding heat due to external connection of components, slow reaction, large volumes, and complicated composition, and they require more constructing space and procedures. Besides, the protection device has to be connected independently outside instead of having one inside.

In UL 1449 3$^{rd}$ Edition (2009) Type 3 was added to Surge Protective Devices (SPDs) requirements. The 3$^{rd}$ Edition also includes the Low voltage Surge Arresters under 1000V in the requirements, and the title is also altered from Transient Voltage Surge Suppressors into Surge Protective Devices. This shows the importance of integrating the components and the surge arresters of the device.

Hence, the inventor has an invention in U.S. Pat. No. 9,805,899 filed on Nov. 16 2015 which has an anti-surge and linkage disconnection structure built inside a heat-resisting and fireproof housing of an overcurrent protection switch so that the disconnection could be operated successfully and instantly when an overload occurs. Features of the invention disclosed are illustrated in FIGS. 3A-4B, a switch module of built-in anti-surge and linkage disconnection structure mainly comprises an overcurrent protection switch and an anti-surge and linkage disconnection structure 700 ingeniously built inside a heat-resisting housing 310. The switch module 300 has a first connecting point 4210 and a second connecting point 5110 for operation. When overvoltage occurs, the temperature of at least one metal oxide varistor 710 would instantly rise up to a degree higher than the melting point thereof, melting at least one thermo-sensitive piece 720, loosening at least one spring element 730, displacing a pushing element 750, and thus forcing the connecting points detaching from each other to turn off the switch and stop supplying the electricity power to metal oxide varistor 710, so as to ensure more of electricity safety. However, the manufacturing process of forming the structure of the thermo-sensitive piece 720 for loosening the spring element 730 for displacing a pushing element 750 is complicated and it is hard to control the melting status of the thermo-sensitive piece 720, so the invention need to improve the accuracy and the stability.

SUMMARY OF THE INVENTION

A primary object of the present invention is to provide a switch module with a built-in structure of anti-surge and linkage disconnection that has not only the original function of overcurrent protection but further includes linkage disconnection and anti-surge function to ensure more of electricity safety. Instead of a thermo-sensitive piece that fixing a conductive spring element, the present invention has a linear expanded graphite which can be expanded by absorbing heat and forms a cocoon form protection structure that fill up the containing space like a spider web, and further achieve the effects of easy manufacturing and improving the stability and the accuracy.

To achieve the objects mentioned above, the present invention comprises a housing having a press button arranged atop thereof, and a first conductive plate, a second conductive plate and a third conductive plate arranged at a lower section thereof; said first conductive plate being connected to a binary alloy conductive plate having a first connecting point, and the second conductive plate having a second connecting point on the surface of an upper section thereof corresponding to the first connecting point; a moving rod linking up the bottom of the press button with one end and the binary alloy conductive plate with the other end for the first connecting point to contact the second connecting point, consequently turning on the switch, and for the first connecting point to detach from the second connecting point when current overload occurs and the binary alloy conductive plate is deformed due to high temperature, consequently turning off the switch, so as to form an overcurrent protection switch;

Wherein a structure of anti-surge and linkage disconnection is built inside the housing, characterized in that: an anti-surge instant expanding detaching device with a cocoon form protection structure which build in housing including:

an explosion proof case having an outward opening hole and a predetermined space for containing; at least a clad metal oxide varistor being disposed inside the explosion proof case having a first conductor wire and a second conductor wire, and the first conductor wire and the second conductor wire can be extended through the explosion proof case and electrically connected to the first conductive plate and the third conductive plate; an expanded graphite, said expanded graphite wrap up the metal oxide varistor and fill up the explosion proof case; a pushing element having a cap, at the bottom edge of the cap having a pushing rod which can do linear movement arranged at the opening of the explosion proof case, and at least a part of the cap is contacting the expanded graphite; whereby when the first connecting point is contacting the second connecting point, when an overvoltage occurs, the metal oxide varistor would instantly heat up or explode, and the expanded graphite is linear expanded by absorbing heat and forms a cocoon form protection structure that fill up the containing space like a spider web covering the metal oxide varistor, the protection structure is expanded when the temperature is rising, when the expanding volume of the expanded graphite reach the predetermined setting, the expansion provides a push force to push the pushing element forcing the first connecting point detaching from the second connecting point and turn off the switch.

Also, the explosion proof case has a first through hole for the first conductor wire and the second conductor wire to set through.

Also, the explosion proof case is in a shape of box and having a least one extended arm at the right and left side, at the bottom edge of the extended arm having a hook arranged inward; the cap of the pushing element is an upward U shape structure, on the both side of the cap has a protruding part embedded with the extended arm and the top of the protruding part has a stairs surface and at the bottom surface has a bevel surface, and the pushing element can be fixed into the opening of the explosion proof case and can move linearly in longitudinal direction.

Also, the hook buckled the bevel surface for fixing the pushing element to make sure the expanded graphite stays inside the explosion proof case during erecting and to make the pushing rod keep detached from the binary alloy conductive plate.

Also, the expanded graphite expands linearly by absorbing heat, when the expanding volume of the expanded graphite reach the predetermined setting, the expansion provides a push force to push the pushing element to move linearly for the bevel surface of the protruding part of the pushing element to be detached from the hook of the extended arm, and the pushing rod forces the first connecting point of the binary alloy conductive plate to be detached from the second connecting point, after the pushing element moved linearly, the stairs surface against the bottom of the hook to prevent the pushing element from moving back.

Also, the first conductive plate has a first connecting part protruded forward, the third conductive plate has a second connecting part protruded forward; the housing has a housing cover at the lateral side, the housing cover has a second through hole for the first and the second conductor wire to set through, corresponding to the first connecting part of the first connecting plate and the third connecting part of the third connecting plate has a third through hole, after the first and the second conductor wire set through the second through hole, the conductor wire electrically connected to the first connecting part and the second connecting part.

With structures disclosed above, the present invention complements the defect of a conventional overcurrent protection switch that it must connect to a metal oxide varistor from the outside by having the anti-surge and linkage disconnection structure ingeniously built inside the heat-resisting and fireproof housing. When receiving exceedingly high voltages, the expanded graphite expands linearly by absorbing heat, when the expanding volume of the expanded graphite reach the predetermined setting, the expansion provides a push force to push the pushing element to move linearly, therefore forcing the first connecting point detaching from the second connecting point and turning off the switch immediately. Therefore, the present invention is not only overcurrent protective but also overvoltage protective and surge absorbing; also, the manufacturing process is simpler than-thermo-sensitive piece and the spring element structure, ensuring more electricity safety and conveniences in using.

DETAILED DESCRIPTION OF THE PREFERRED EMBODIMENT

Figure 1A:
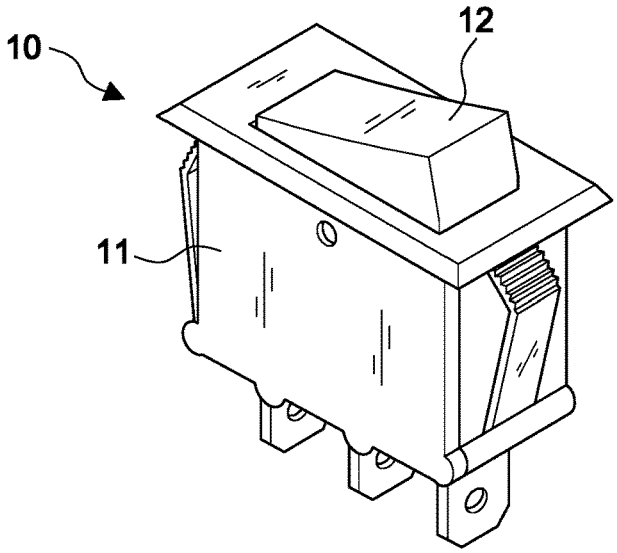
FIG.1A PRIOR ART
FIG. 1A is a perspective view of an overcurrent protection switch according to the prior art.

Referring to FIGS. 5-12, the present invention mainly includes a housing 31 has a press button 32 arranged atop thereof, and a first conductive plate 40 as a positive electrode, a second conductive plate 50 as another positive electrode and a third conductive plate 60 as a negative electrode arranged at a lower section thereof. The first conductive plate 40 is connected to a binary alloy conductive plate 41 that has a spring leaf 42 and a first connecting point 421, and the second conductive plate 50 has a second connecting point 511 corresponding to the first connecting point 421.

Figure 9:
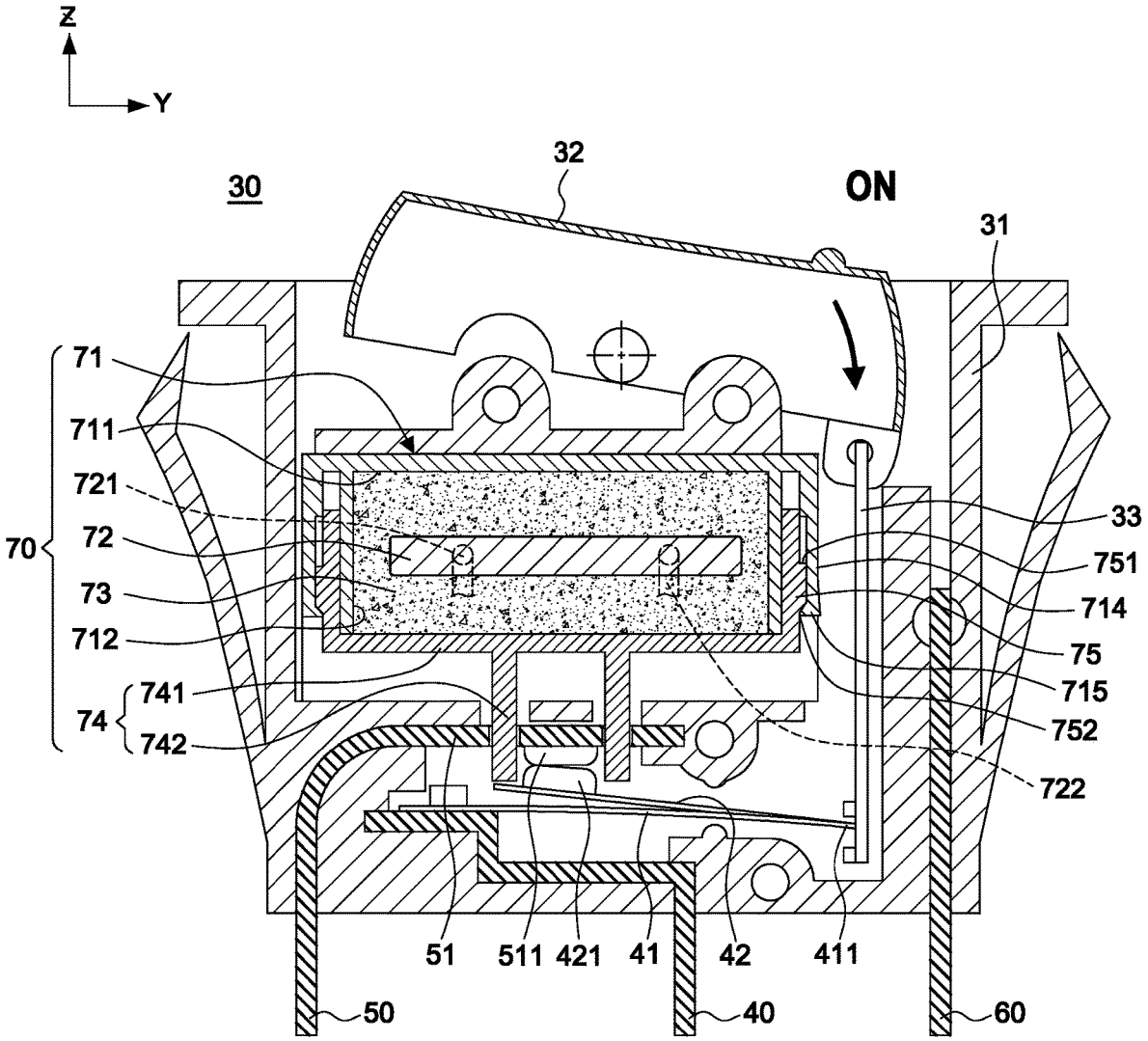
FIG. 9 is a sectional view of the present invention in the first embodiment in an ON status, and the cocoon form protection structure is in the normal status.
Figure 10:
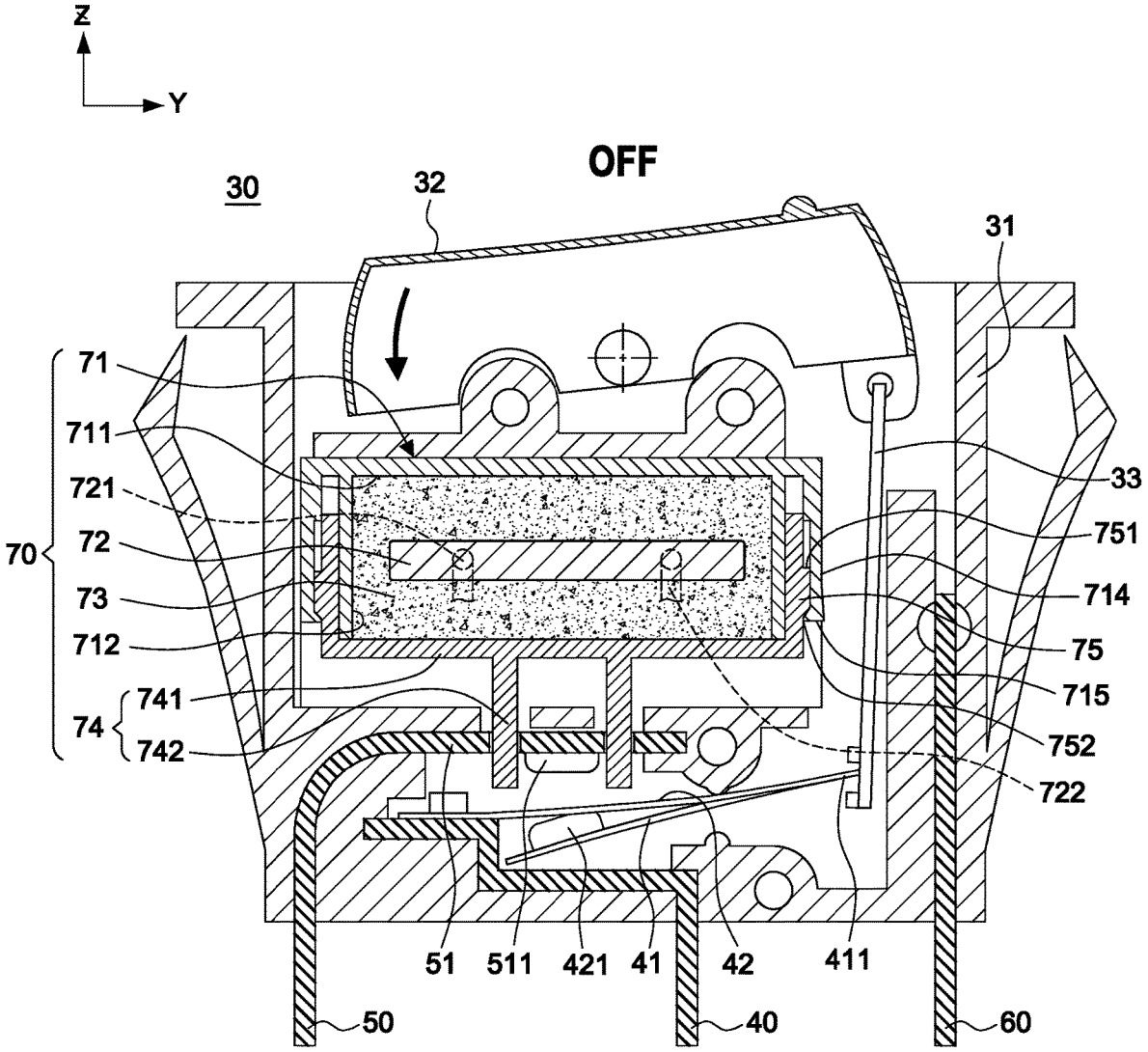
FIG. 10 is a sectional view of the present invention in the first embodiment in an OFF status, and the cocoon form protection structure is in the normal status.

The moving rod 33 has a top end arranged at the bottom of the press button 32 and a bottom end connecting to a movable end 411 of the binary alloy conductive plate 41. With reference to FIG. 9, when pressing the press button 32, the binary alloy conductive plate 41 ejects upwards and the spring leaf 42 ejects downwards to make the first connecting point 421 contacting the second connecting point 511 and thus turn on the switch; when current overload occurs, the binary alloy conductive plate 41 deforms due to high temperature and detach the first connecting point 421 from the second connecting point 511 to turn the switch off back to the original status as shown in FIG. 10, so as to form a switch module 30 with an overcurrent protection switch.

Figure 1B:
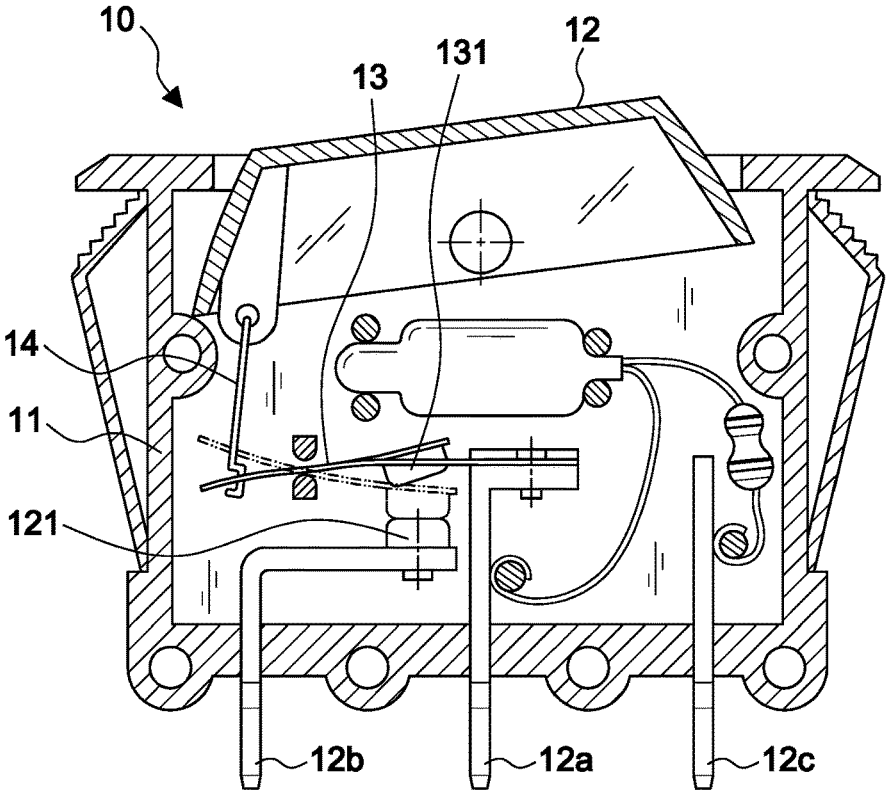
FIG.1B PRIOR ART
FIG. 1B is a section view of an overcurrent protection switch according to the prior art.
Figure 2:
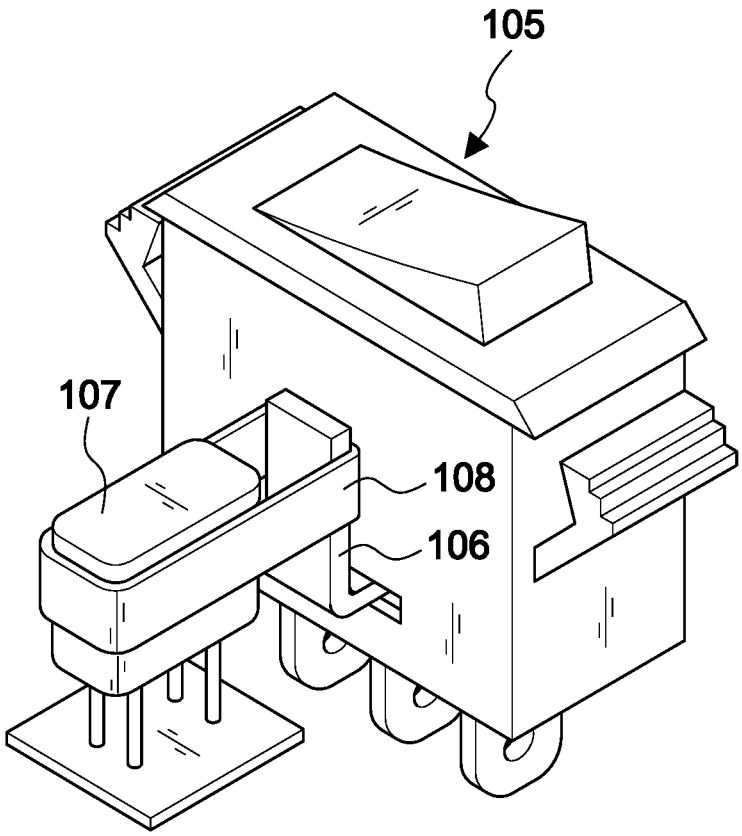
FIG.2 PRIOR ART
FIG. 2 is a perspective view of an anti-surge and linkage disconnection structure according to U.S. Pat. No. 8,643,462.
Figure 3A:
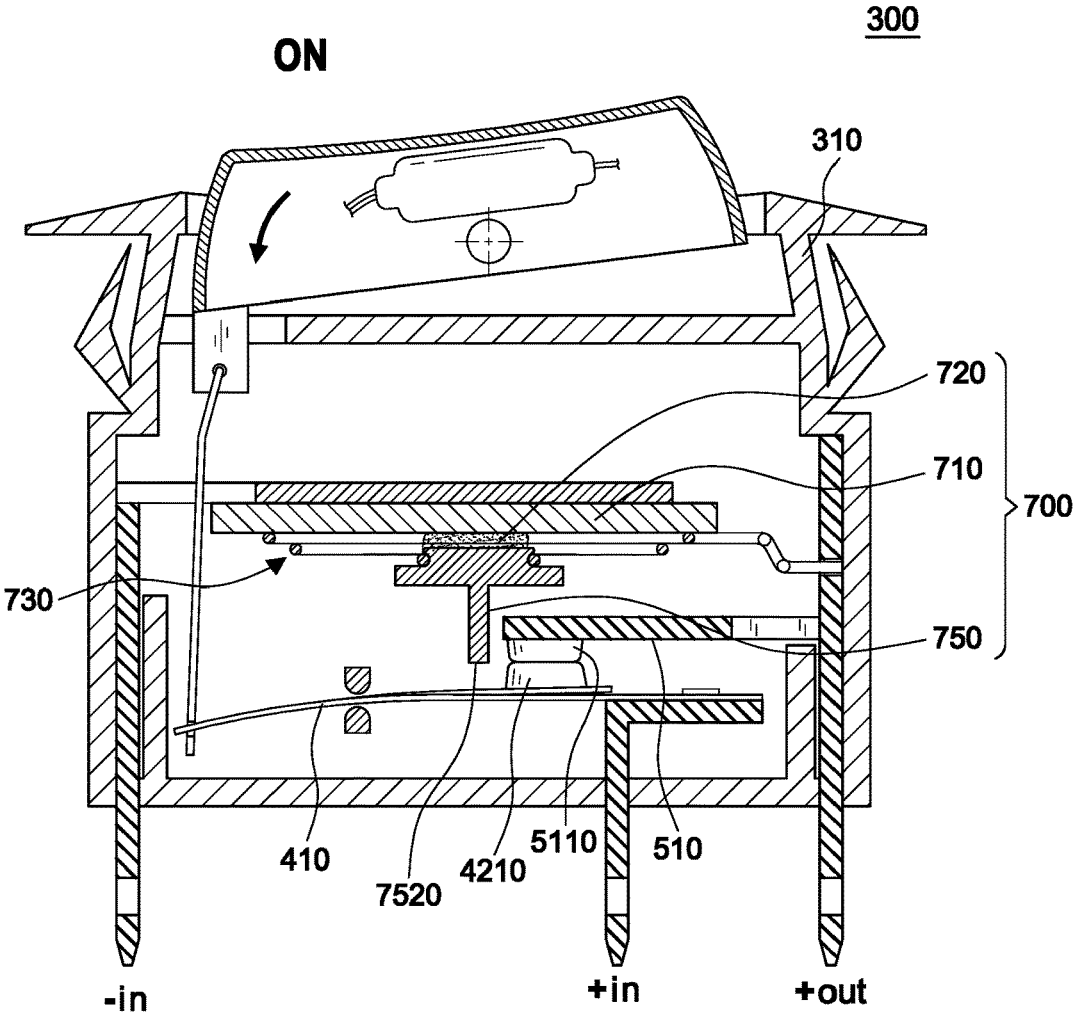
FIG.3A PRIOR ART
FIGS. 3A and 3B are a perspective view of a major structure according to U.S. Pat. No. 9,805,899, showing the status while the moving terminal fixed by the thermo-sensitive piece.
Figure 3B:
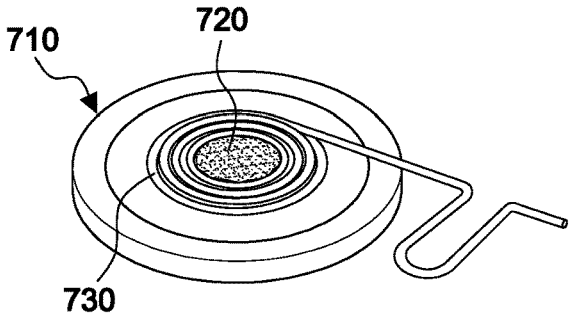
FIG.3B PRIOR ART
Figure 4A:
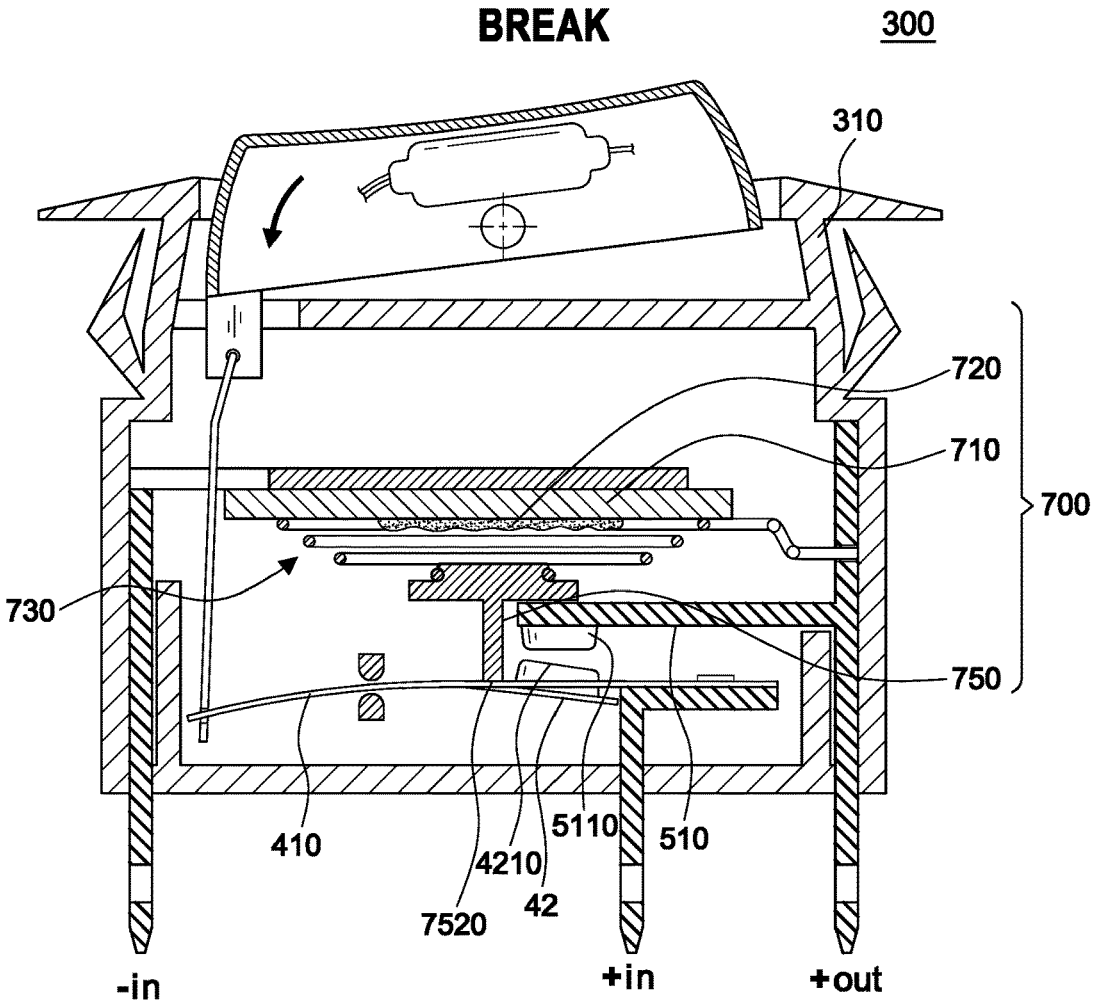
FIG.4A PRIOR ART
FIGS. 4A and 4B are a perspective view of a major structure according to U.S. Pat. No. 9,805,899, showing the status while the moving terminal detached from the thermo-sensitive piece and turning off the switch.
Figure 4B:
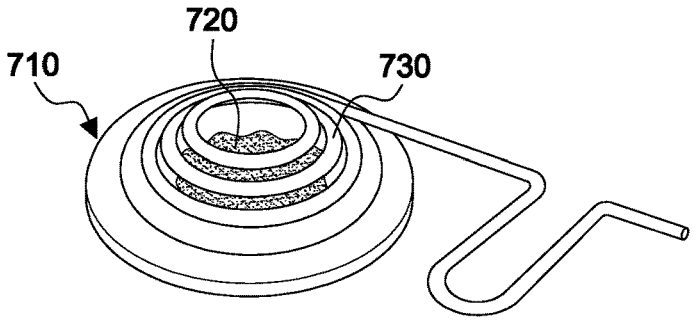
FIG.4B PRIOR ART
Figure 5A:
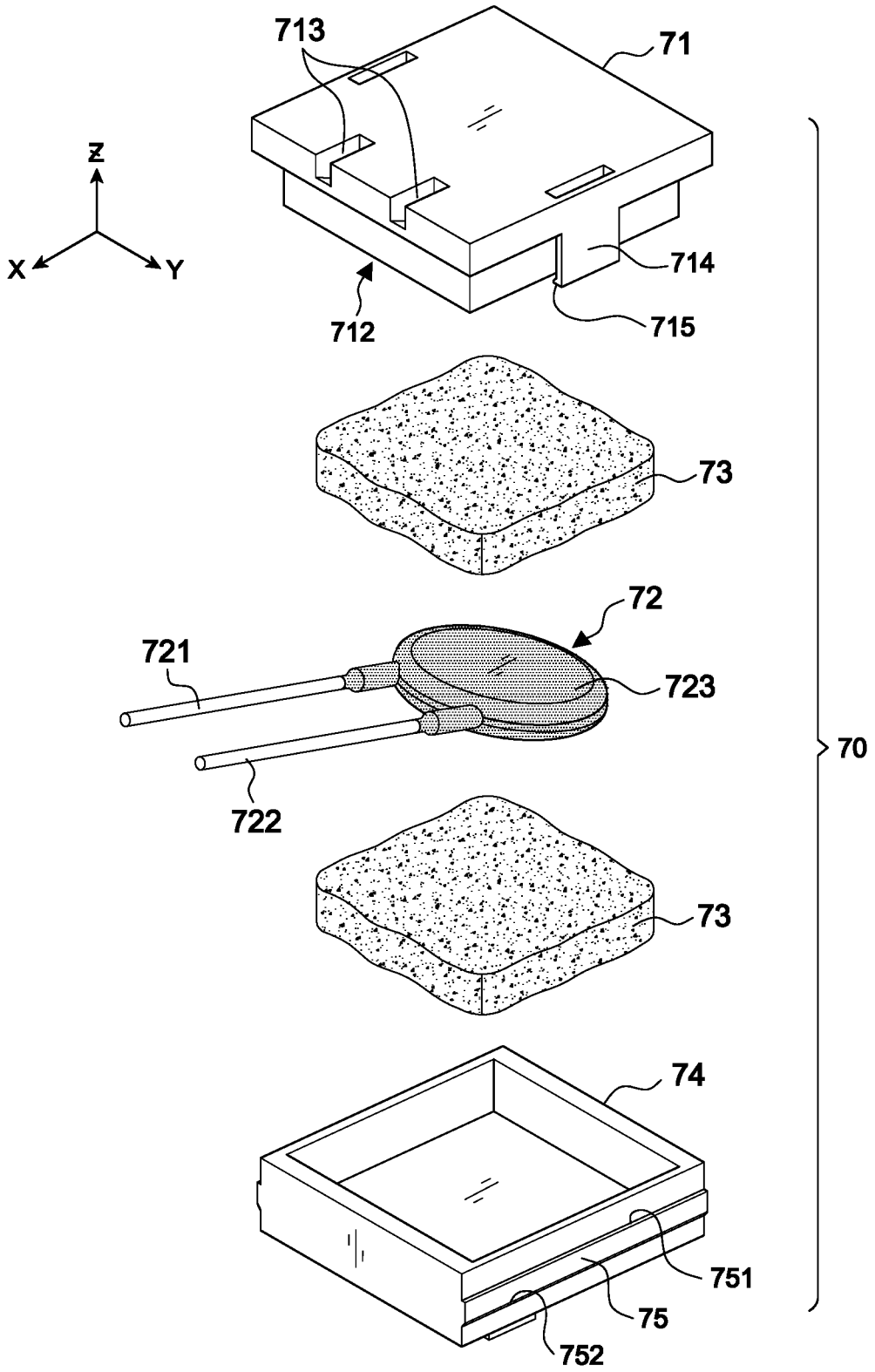
FIG. 5A is an exploded view of a cocoon form protection structure of present invention.
Figure 5B:
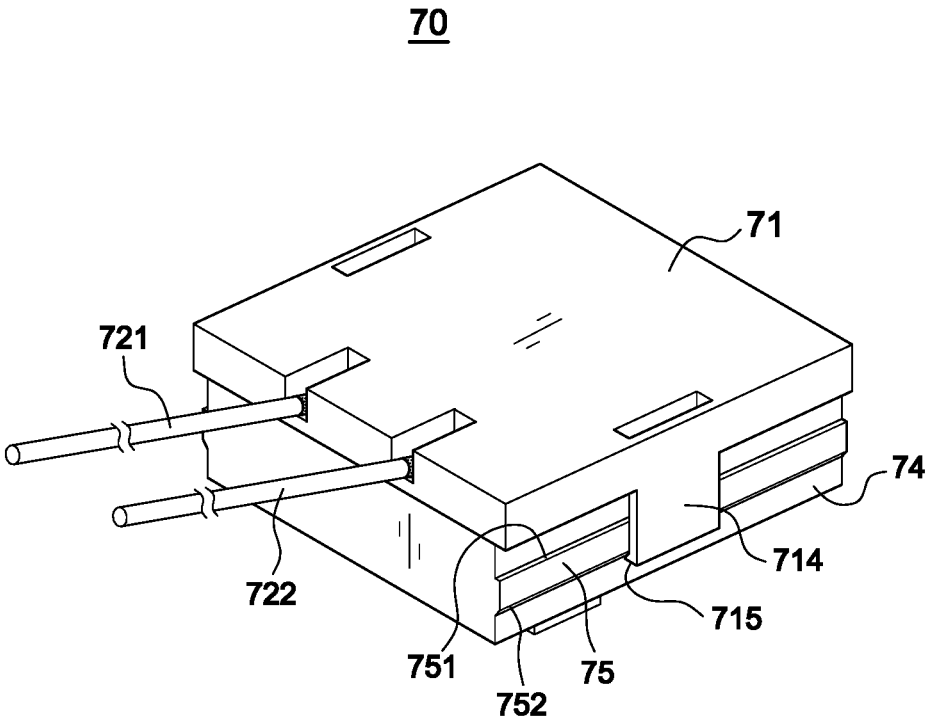
FIG. 5B is an assembly view of a cocoon form protection structure of present invention.

The arrangement of the binary alloy conductive plate 41 and the press button 32 can be different in various switch modules. In this embodiment, the center of the binary alloy conductive plate 41 has the first connecting point 421 arranged on the spring leaf 42 but it is not limited to such application. The binary alloy conductive plate 41 can also arranged the spring leaf 42 and the first connecting point 421 aside the binary alloy conductive plate 41. Also, as the status shown in FIG. 1B, the binary alloy conductive plate 41 is arranged above the surge absorber and the switch, but it can also be upside down.

Figure 8A:
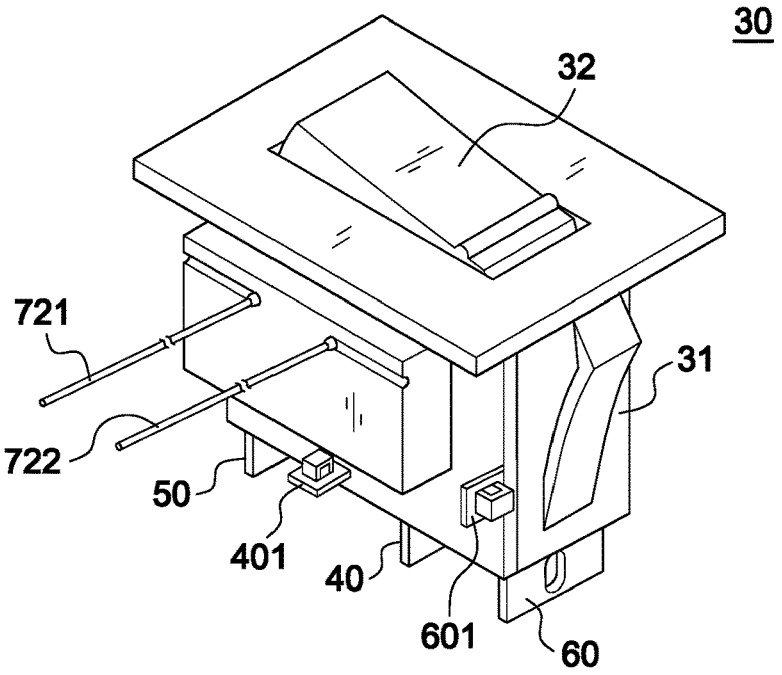
FIG. 8A is an assembly view of the present invention in the first embodiment.
Figure 8B:
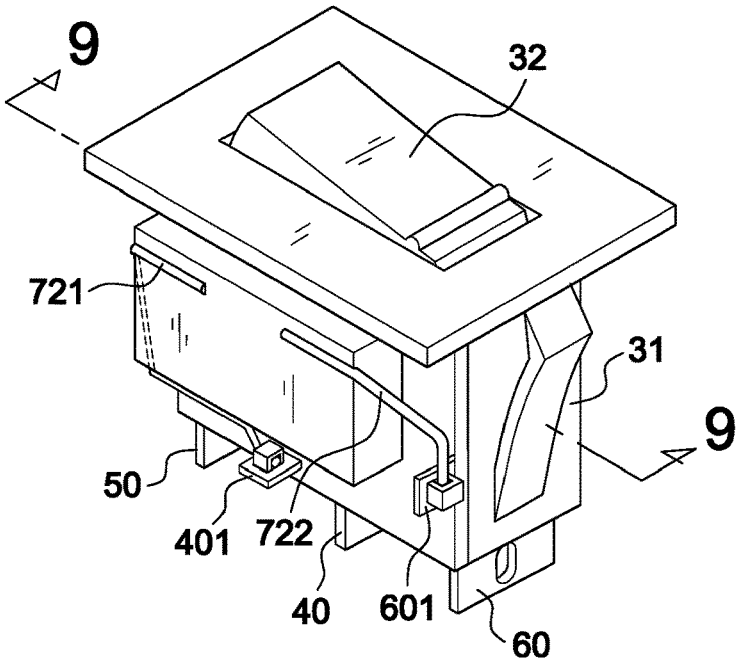
FIG. 8B is another assembly view of the present invention in the first embodiment.

The features of the present invention lies in that the switch module 30 that has an anti-surge instant expanding detaching device with a cocoon form protection structure 70 built inside the housing 31 corresponding to the spring leaf 42 of the binary alloy conductive plate 41, the protection structure 70 comprising:

an explosion proof case 71 having an outward opening hole 712 and a predetermined space 711 for containing; at least a clad metal oxide varistor 72 (surge absorber) being disposed inside the explosion proof case 71 having a first conductor wire 721 and a second conductor wire 722, and the first conductor wire 721 and the second conductor wire 722 can be extended through the explosion proof case 71 and electrically connected to the first conductive plate 40 and the third conductive plate 60, as FIGS. 8A and 8B showing. In this embodiment, the explosion proof case 71 has a first through hole 713 for the first conductor wire 721 and the second conductor wire 722 to set through, as FIGS. 5 A and 5B showing. In this embodiment, the metal oxide varistor 72 of the present invention is a slightly different from the conventional metal oxide varistor 720, the conventional metal oxide varistor 720 is a bare plate, the metal oxide varistor 72 of the present invention has an clad insulation jacket 723, and the first conductor wire 721 and the second conductor wire 722 only need to have insulation jacket 723 partially.

An expanded graphite 73 is covering the metal oxide varistor 72 and fills up the explosion proof case 71; in this embodiment, the expanded graphite 73 has high density and can be granular or powder, by intercalation, washing, high temperature expanding process, and drying a nature flake graphite, produced the expanded graphite with a loose structure having plurality holes. The expanded graphite not only has the characteristics of the nature graphite, such as high temperature resistant, corrosion resistance, radioresistant and nice electric conductivity, but also has the below characteristics: 1). pressure resistance, flexibility, and formability; 2.) high and low temperature resistant, corrosion resistance, and radioresistant 3). anti-knocking; 4). flame retardant; 5). aging resistance and torsional resistance; 6). avoid osmosis from metal; 7). non-toxic substance.

Also, the expanded graphite starts to expand at 150-200° C., the expanded volume is huge and stable, therefore, it has the characteristics of absorbing heat, instant expanded while receiving heat and burn resistant, therefore, the present invention chooses expanded graphite as basic material.

A pushing element 74 having a cap 741, at the bottom edge of the cap 741 having a pushing rod 742 which can do linear movement arranged at the opening 712 of the explosion proof case 71, and at least a part of the cap 741 is contacting the expanded graphite 73; in this embodiment, the cap 741 is arranged inside the opening 712 of the explosion proof case 71, or the cap 741 can also be arranged outside the opening 712; and the pushing element 74 having two pushing rod 742, but the present invention is not limited to such application.

In this embodiment, the explosion proof case 71 is in a shape of box and having a least one extended arm 714 at the right and left side, at the bottom edge of the extended arm 714 having a hook 715 arranged inward; the cap 741 of the pushing element 74 is an upward U shape structure, on the both side of the cap 741 has a protruding part 75 embedded with the extended arm 714 and the top of the protruding part 75 has a stairs surface 751 and at the bottom surface has a bevel surface 752, and the pushing element 74 can be fixed into the opening 712 of the explosion proof case 71 and can move linearly in longitudinal (Z) direction.

Figure 6:
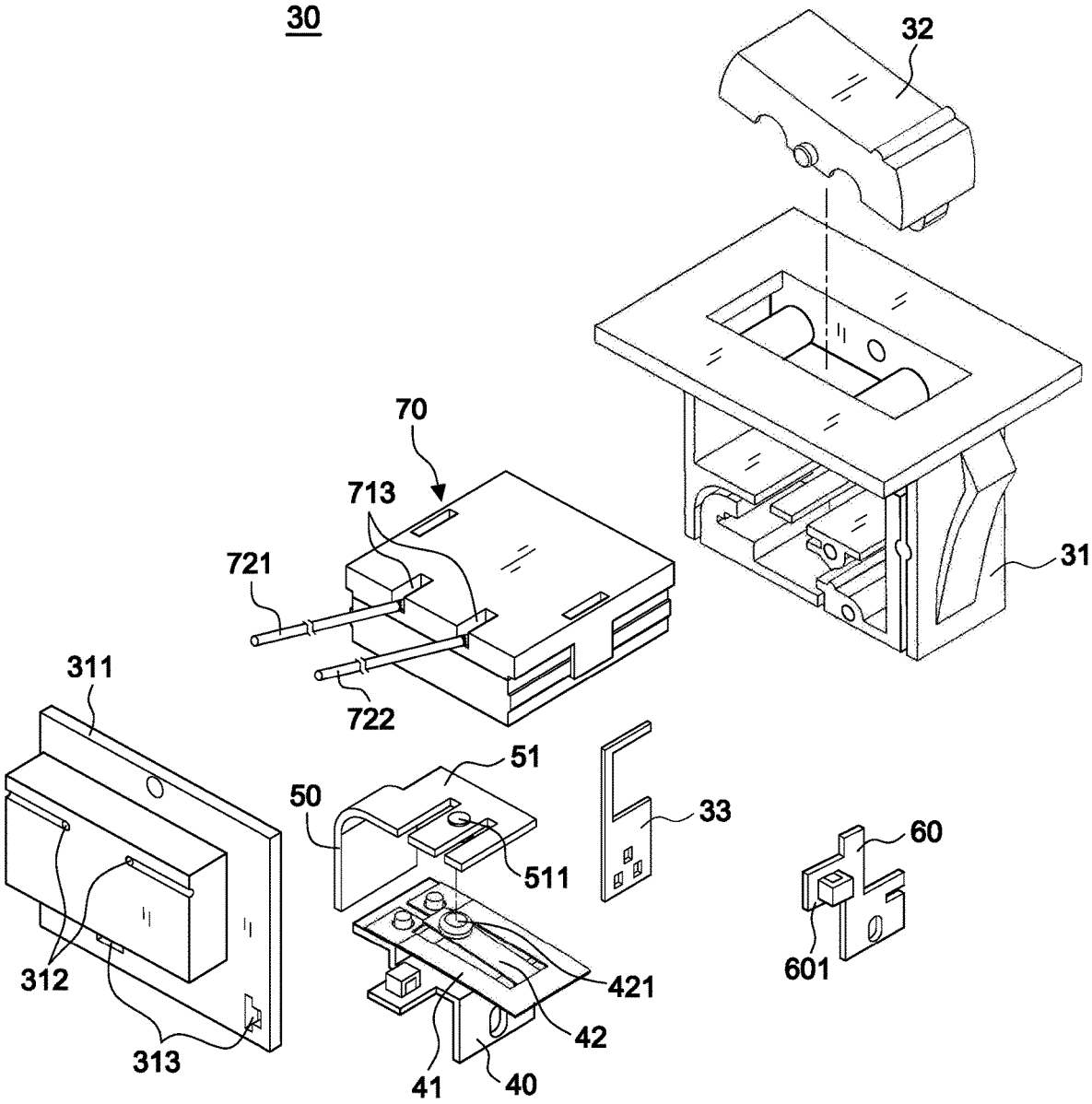
FIG. 6 is an exploded view of major components of the present invention in the first embodiment.
Figure 7:
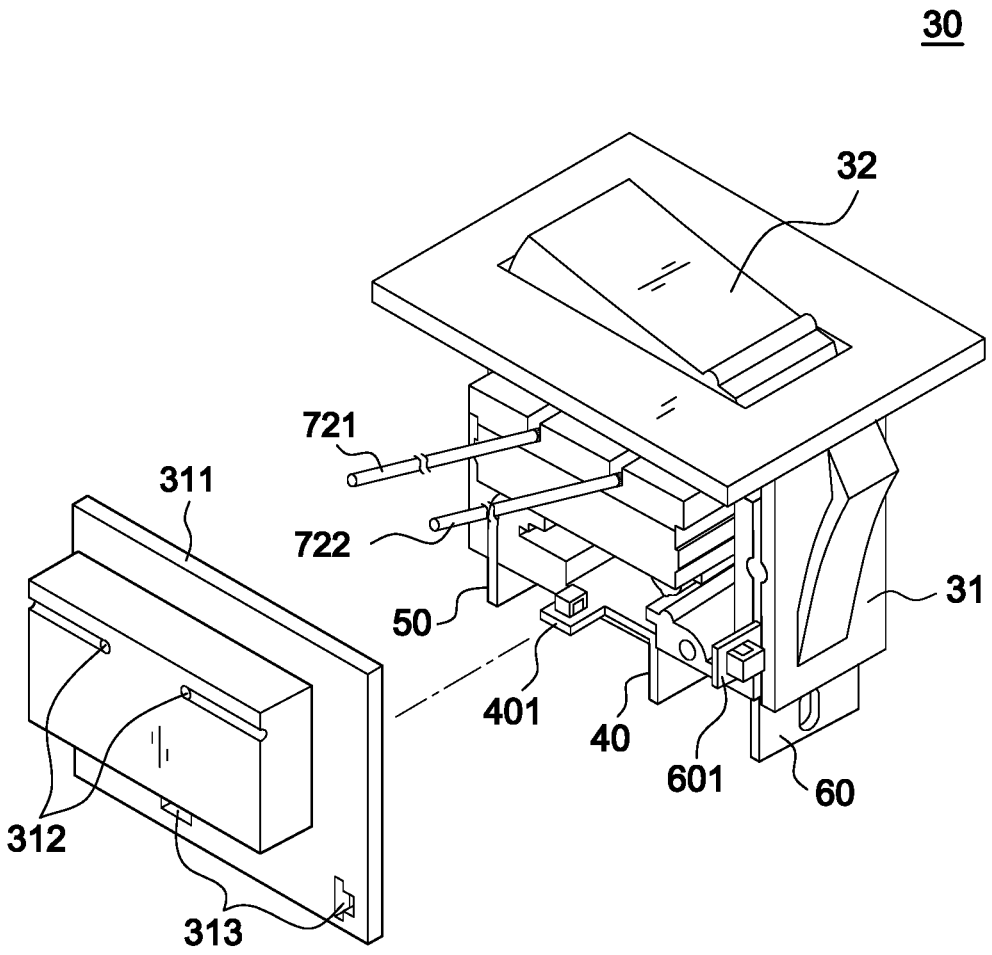
FIG. 7 is an exploded view of partial components of the present invention in the first embodiment.

FIG. 6 and FIG. 7 are exploded view of major components of the present invention in the first embodiment, in this embodiment, the first conductive plate 40 has a first connecting part 401 protruded forward, the third conductive plate 60 has a second connecting part 601 protruded forward; the housing 31 has a housing cover 311 at the lateral side, the housing cover 311 has a second through hole 312 for the first conductor wire 721 and the second conductor wire 722 to set through, corresponding to the first connecting part 401 of the first connecting plate 40 and the second connecting part 601 of the third connecting plate 60 has a third through hole 313.

FIG. 8A and FIG. 8B are assembly view of major components of the present invention in the first embodiment, after the first 721 and the second conductor wire 722 set through the second through hole 312, the conductor wire electrically connected to the first connecting part 401 and the second connecting part 601, and the connecting method can be riveting joint, soldered joint, or pressing joint.

As FIG. 9 and FIG. 10 showing, when the switch module works normal situation, the hook 715 buckled the bevel surface 752 for fixing the pushing element 74 to make sure the expanded graphite 73 stays inside the explosion proof case 71 during erecting and to make the pushing rod 742 keep detached from the binary alloy conductive plate 42.

Figure 11:
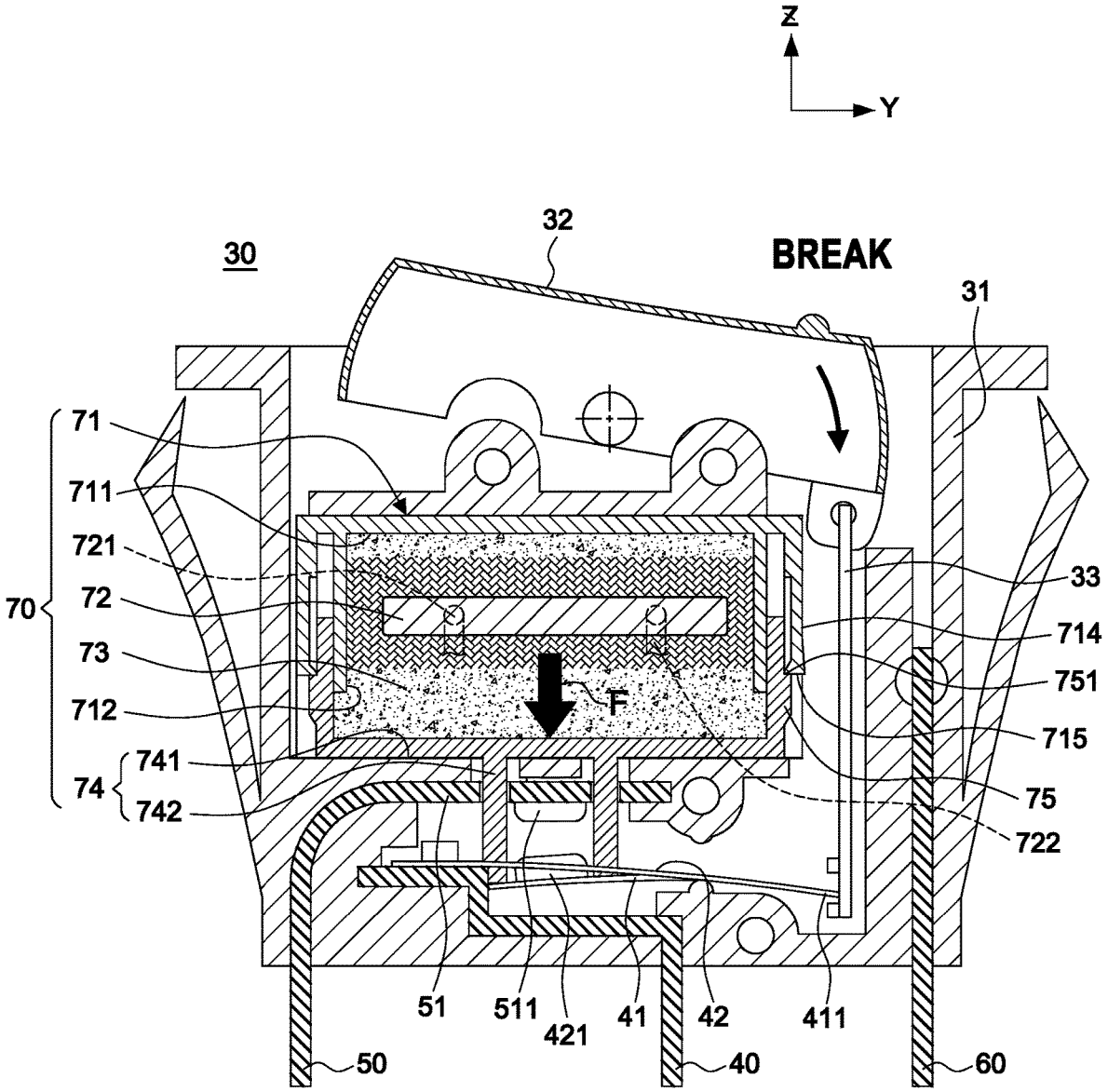
FIG. 11 is a sectional view of the present invention in the first embodiment in a BREAK status, and the cocoon form protection structure is expanded.
Figure 12:
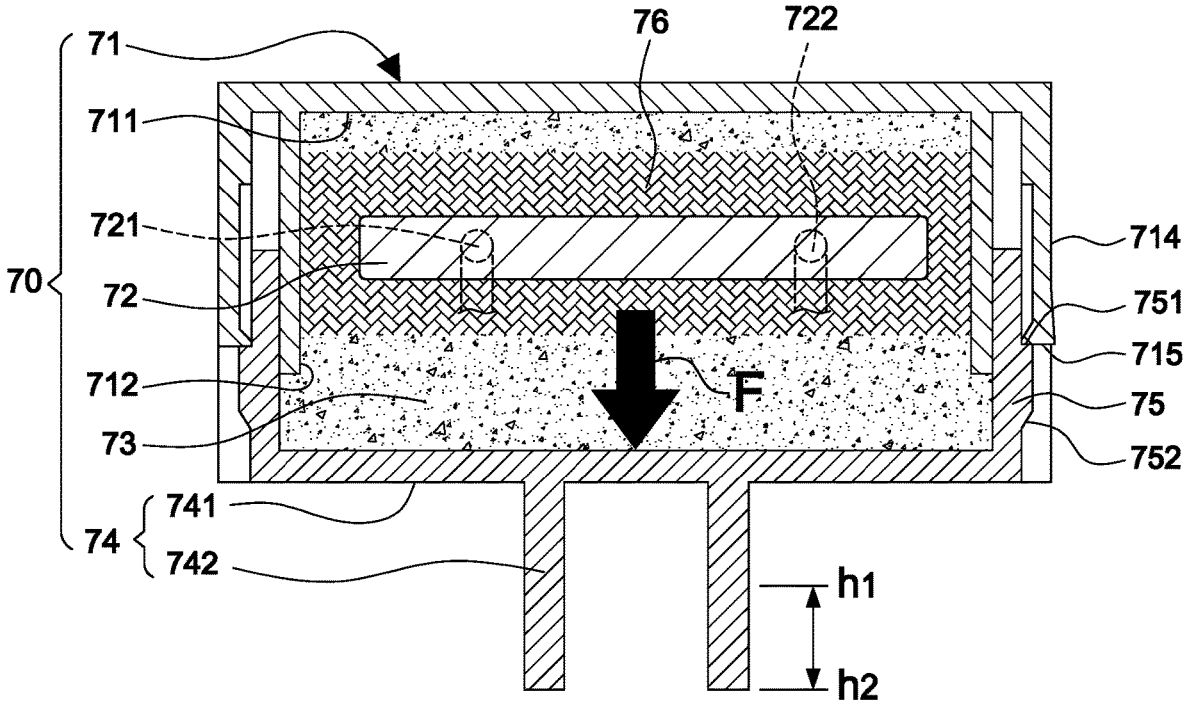
FIG. 12 is a zoom in view of the expanded status of the cocoon form protection structure of the present invention in the first embodiment.

As FIG. 11 and FIG. 12 showing, when the switch module 30 works in abnormal situation, the expanded graphite 73 expand linearly by absorbing heat and produce a longitudinal (Z direction) force, and push the pushing element 74 to move linearly for the bevel surface 752 of the protruding part 75 of the pushing element 74 to be detached from the hook 715 of the extended arm 714, and the height of the pushing rod 742 descend from h1 to h2 and forces the first connecting point 421 of the binary alloy conductive plate 42 to be detached from the second connecting point 511, after the pushing element 74 moved linearly, the stairs surface 751 against the bottom of the hook 715 to prevent the pushing element 74 from moving back. As above mentioned, the expanded graphite starts to expand at 150-200° C., the expanded graphite has the characteristics of high heat conductivity, huge expanded volume and low expanding temperature; therefore, when the metal oxide varistor 72 heating up or exploded, the expanded graphite 73 absorbs the heat immediately and expands linearly, and then the expanded graphite 73 forms a cocoon form protection structure 76 that fill up the containing space like a spider web having the function of flame proof Whereby when the first connecting point 421 is contacting the second connecting point 511, when overvoltage occurs, the metal oxide varistor 72 would instantly heat up or explode, and the expanded graphite 73 is linear expanded by absorbing heat and forms a cocoon form protection structure 76 that fill up the containing space like a spider web covering the metal oxide varistor 72, when the expanding volume of the expanded graphite 73 reach the predetermined setting, the expansion provides a push force to push the pushing element 74 forcing the first connecting point 421 detaching from the second connecting point 511 and turn off the switch, and further stops the metal oxide varistor 72 from heating up and delivering power. By the feature disclosed above, the present invention uses the instant expanding characteristics of the expanded graphite 73 to form a cocoon form protection structure 76 that fill up the containing space like a spider web to build a flame proof protection structure.

Figure 13:
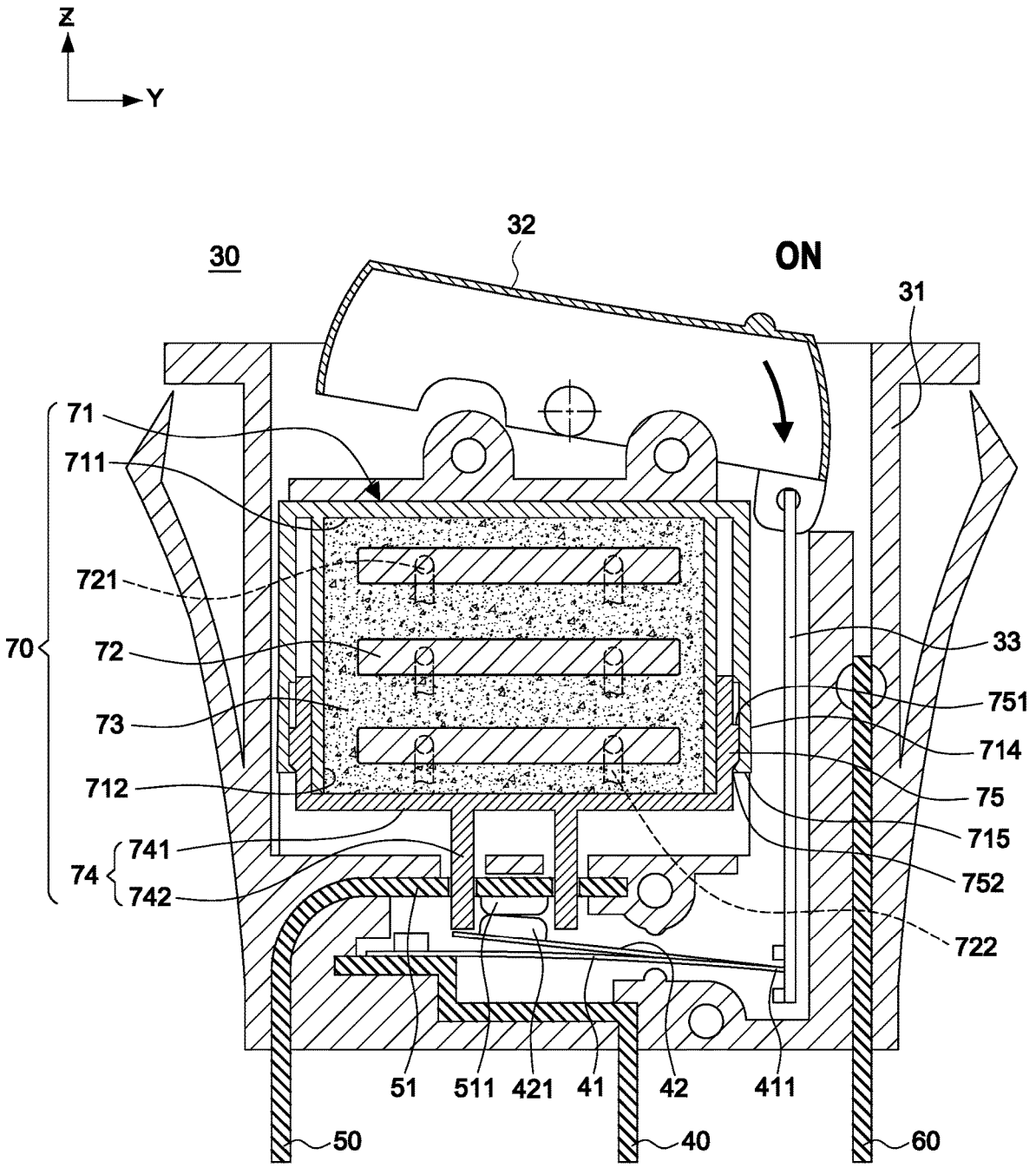
FIG. 13 is a sectional view of the major structure in the second embodiment.

Moreover, the metal oxide varistor 72 above mentioned is a 2 way circuit, but the present invention is not limited to such application; FIG. 13 is a sectional view of the major structure in the second embodiment, it shows that the flame proof protection structure 70 comprises: at least two metal oxide varistor 72 which can be a 2 way or 3 way circuit. Therefore, the flame proof protection structure 70 can increase the quantity of the metal oxide varistor 72 by requirement, the metal oxide varistor 72 can be arranged inside the containing space 711 of the explosion proof case 71 in longitudinal or horizontal direction, and the explosion proof case 72 have a first conductor wire 721 and a second conductor wire 722 set through the housing cover 311 of the housing 31, and connect to predetermined conductive plate.

Hence, inside the housing 31 of the present invention, having a switch forms by the binary alloy conductive plate 41 and the connecting points 421, 511, and a cocoon form protection structure 70 forms by the explosion proof case 71, the metal oxide varistor 72, the expanded graphite 73, and pushing element 74. The switch is a conventional component, the arrangement of different type of switch module may be different, however, no matter where the module is arranged, the technical means of the cocoon form protection structure 70 which the present invention used will not be affected, when The first connecting point 421 contacting the second connecting point 511 and thus turn on the switch and current overload occurs, the metal oxide varistor 72 will heat up or explode, then the expanded graphite 73 expanded outward and further push the pushing element 74 displaced, and turn off the switch. Moreover, the present invention is not limited to the composing illustrated in drawings above, changing the arranged position of the switch, or add component such as fuse, gas discharge tube, anti-noise capacitance, or changing the pin still falls within the embodiment of the present invention.

Although particular embodiments of the invention have been described in detail for purposes of illustration, various modifications and enhancements may be made without departing from the spirit and scope of the invention. Accordingly, the invention is not limited except as by the appended claims.

What is claimed is:

1. A switch module with a built-in structure of anti-surge and linkage disconnection, particularly to one that has an anti-surge instant expanding detaching device with a cocoon form protection structure, comprising:

a housing having a press button arranged atop thereof, and a first conductive plate, a second conductive plate and a third conductive plate arranged at a lower section thereof; said first conductive plate being connected to a binary alloy conductive plate having a first connecting point, and the second conductive plate having a second connecting point on a surface of an upper section thereof corresponding to the first connecting point;

a moving rod linking up a bottom of the press button with one end of the moving rod and linking up the binary alloy conductive plate with another end of the moving rod so that the first connecting point contacts the second connecting point to turn on the switch module, and for the first connecting point to detach from the second connecting point when current overload occurs and the binary alloy conductive plate is deformed due to high temperature, consequently turning off the switch module; characterized in that:

the anti-surge instant expanding detaching device with the cocoon form protection structure which is built in the housing includes:

an explosion proof case having an outward opening hole and a containing space therein;

at least a clad metal oxide varistor that is disposed inside the explosion proof case and has a first conductor wire and a second conductor wire, and the first conductor wire and the second conductor wire extend through the explosion proof case and are electrically connected to the first conductive plate and the third conductive plate;

an expanded graphite, said expanded graphite wraps up the clad metal oxide varistor and fills up the explosion proof case;

a pushing element having a cap, at a bottom edge of the cap has a pushing rod that moves linearly along the outward opening hole of the explosion proof case, and at least a part of the cap contacts the expanded graphite;

whereby when the first connecting point contacts the second connecting point, and when an overvoltage occurs, the clad metal oxide varistor instantly heats up or explodes, and the expanded graphite simultaneously expands linearly and forms the cocoon form protection structure that fills up the containing space like a spider web that covers the clad metal oxide varistor and forms a flame proof layer, the expanded graphite expands as the temperature of the clad metal oxide varistor rises, when an expanding volume of the expanded graphite reaches a predetermined setting, the expanding volume provides a push force to push the pushing element to force the first connecting point to detach from the second connecting point and turn off the switch module.

2. The switch module with a built-in structure of anti-surge and linkage disconnection as claimed in claim 1, wherein the explosion proof case has a first through hole for the first conductor wire and the second conductor wire to extend through.

3. The switch module with a built-in structure of anti-surge and linkage disconnection as claimed in claim 1, wherein the explosion proof case is in a shape of box and has at least one extended arm at a right and left side, a bottom edge of the extended arm having a hook that is arranged inward; the cap of the pushing element is an upward U shape structure, and both sides of the cap have a protruding part that is embedded with the extended arm and a top of the protruding part has a stairs surface and at a bottom surface of the protruding part has a bevel surface, and the pushing element is fixed into the opening hole of the explosion proof case moves linearly in a longitudinal direction.

4. The switch module with a built-in structure of anti-surge and linkage disconnection as claimed in claim 3, wherein the hook is buckled to the bevel surface to fix the pushing element to make sure the expanded graphite stays inside the explosion proof case and to make sure the pushing rod does not contact the binary alloy conductive plate when the switch module is on.

5. The switch module with a built-in structure of anti-surge and linkage disconnection as claimed in claim 4, wherein the expanded graphite expands linearly by absorbing heat from the clad metal oxide varistor, when the expanding volume of the expanded graphite reaches the predetermined setting, the expanding volume provides the push force to push the pushing element to move linearly for the bevel surface of the protruding part of the pushing element to be detached from the hook of the extended arm, and the pushing rod forces the first connecting point of the binary alloy conductive plate to be detached from the second connecting point, after the pushing element is moved linearly, the hook is engaged with the stairs surface to prevent the pushing element from moving back.

6. The switch module with a built-in structure of anti-surge and linkage disconnection as claimed in claim 1, wherein the first conductive plate has a first connecting part that is protruded forward, the third conductive plate has a second connecting part protruded forward; the housing has a housing cover at a lateral side of the housing, the housing cover has a second through hole for the first and the second conductor wire to extend through and a third through hole that corresponds to the first connecting part of the first connecting plate and the second connecting part of the third connecting plate, and after the first and the second conductor wire extend through the second through hole, the first and second conductor wire are electrically connected to the first connecting part and the second connecting part.

* * * * *